United States Patent [19]

Ostrowsky

[11] 4,382,521

[45] May 10, 1983

[54] VENTED CLOSURE

[75] Inventor: Efrem M. Ostrowsky, Highland Park, Ill.

[73] Assignee: Ethyl Products Company, Richmond, Va.

[21] Appl. No.: 284,230

[22] Filed: Jul. 17, 1981

[51] Int. Cl.[3] ..... B65D 51/16

[52] U.S. Cl. ..... 215/307

[58] Field of Search ..... 215/307, 260; 220/366, 220/367

[56] References Cited

U.S. PATENT DOCUMENTS

| | | | |
|---|---|---|---|
| 2,990,079 | 6/1961 | Garvey | 215/260 |
| 3,010,596 | 11/1961 | Williams et al. | 215/307 X |
| 3,144,154 | 8/1964 | Puse et al. | 215/260 |
| 3,612,325 | 10/1971 | Williams | 215/329 |
| 4,007,851 | 2/1977 | Walker | 215/307 |
| 4,206,852 | 6/1980 | Dunn et al. | 215/307 X |

*Primary Examiner*—Donald F. Norton

*Attorney, Agent, or Firm*—Donald L. Johnson; John F. Sieberth; Edgar E. Spielman, Jr.

[57] ABSTRACT

A thermoplastic closure suitable for fitment to a threaded container neck is disclosed. The closure has a top wall with an annular sidewall depending therefrom. To provide a gas-tight seal between the closure and the container, there is provided a gas-tight sealing system above the closure thread. About the inside surface of the annular sidewall is an extended closure thread which, due to its extent, requires the user to make two turning motions to achieve removal of the closure from the container. By requiring two turning motions, sufficient time is provided for venting of any pressurized gas from the container to the atmosphere. This venting can be facilitated by the utilization of any conventional venting means.

4 Claims, 3 Drawing Figures

VENTED CLOSURE

BACKGROUND OF THE INVENTION

The utilization of threaded closures in packaging of carbonated beverages has become very popular. The popularity is due in part to the fact that the consumer can open the package by merely unscrewing the closure from the container. No "bottle opening" tool is needed. Another advantage is that the consumer is able to remove the closure, dispense part of the contents from the container and reclose the container by merely screwing the closure back thereon. Since the sealing system is generally of high fidelity, there will be little loss of carbonation and the remaining packaged product will be suitable for use at a later time.

Despite these advantages, the threaded container-closure package has potentially a serious problem, i.e., premature release of the closure from the container which can occur with great force. The premature release generally occurs as the user unscrews the closure to remove it from the container. Unscrewing of the closure results in lessened thread engagement between the closure and container threads until all engagement is lost and the closure can be removed from the container. Also, the initial unscrewing of the closure results in breaking the seal between the top of the closure and the top of the container. Upon loss of the seal, pressurized gas enters between the sidewall of the closure and the container tending to bulge the closure sidewall outwardly. As the closure sidewall bulges outwardly, the closure threads are pulled away from normal full contact with the container threads. The blow-off or premature release occurs when the pressure of the gas in the container is able to overcome the engagement of the closure thread with the container thread. The bulging out of the closure sidewall compounds the problem as it diminishes thread contact and thus the holding power of the thread engagement.

Venting of the pressurized gas helps reduce the blow-off problem somewhat. Venting can be accomplished, for example, by using a vertical vent slot on the container or closure. With the vent slot, the gas is not trapped between the closure sidewall and the container neck. However, there is still a chance for blow-off if the thread engagement is lessened too quickly as sufficient time will not have passed for the pressurized gas to complete its venting. For some closures, complete unscrewing of the closure from the container can take as little as one-half of a second. Clearly, in this amount of time venting has only started and pressure in the container is still high.

Therefore, it is an object of this invention to provide a threaded closure which, due to its particular features, requires an unscrewing time sufficiently long to provide adequate venting time.

THE INVENTION

This invention relates to an improved thermoplastic closure suitable for use in packaging products, i.e., carbonated beverages, which develop internal package pressure. The closure has a top wall and an annular downwardly depending sidewall. On the inside surface of the sidewall there is provided an extended closure thread traversing from about 400 to about 500 degrees. Above the closure thread and adjacent the inside surface of the top wall, there is provided a sealing system which forms a gastight seal with the top of the container lip. A venting system is utilized to vent pressurized gas from the container to the atmosphere upon loss of the gas-tight seal. It has been found that provision of a vertical venting groove on the container finish or a vertical venting groove on the inside wall of the closure provides a suitable venting system for the closure of this invention. If the closure is to be utilized on a glass container, irregularity in the container thread may in itself be sufficient to provide sufficient venting escapement as the closure thread will not be able to form sealing contact with the irregular glass threads.

It has been found by utilizing an extended closure thread that a user of the closure of this invention will be required to make two turning actions to remove the closure from the container. The first turning action will not remove the closure and will leave the closure thread with sufficient engagement with the container thread so that blow-off of the closure is highly unlikely. To accomplish the second turning action, the user will have to release the closure and regrip it so that the user's hand will be positioned for achievement of this last turning motion. By requiring the user to use two turning motions, sufficient time will have elapsed so that venting will at least be nearly complete. It has been found that a typical user, to accomplish the two turning motions, will require from about 1½ to about 3 seconds to remove the closure of this invention from a container.

Another advantage of utilizing an extended closure thread is that maximum container thread to closure thread engagement is achieved for the longest possible period of time during the screwing of closure 10. By maximizing thread engagement, blow-off is less likely. If a shorter thread is utilized, diminishment of the closure-container thread engagement begins almost as soon as the closure is first unscrewed from the container.

If the closure of this invention is to be utilized on a container having an outward annular protuberance adjacent the bottom portion of the container thread, the extended closure thread must not be so long so that it will ride over the annular protuberance. The annular protuberance may be utilized in conjunction with a tamperproof system such as the one disclosed in U.S. Pat. No. 4,206,851.

The closure of this invention is preferably of a thermoplastic material such as polypropylene, high density polyethylene, polyethylene terephthalate and the like. Injection molding techniques may be used in producing the closure.

These and other features of this invention contributing to satisfaction and use in economy of manufacture will be more clearly understood when taken in connection with the following description of the preferred embodiment and the accompanying drawings in which identical numerals refer to identical parts in which.

Figure 1:
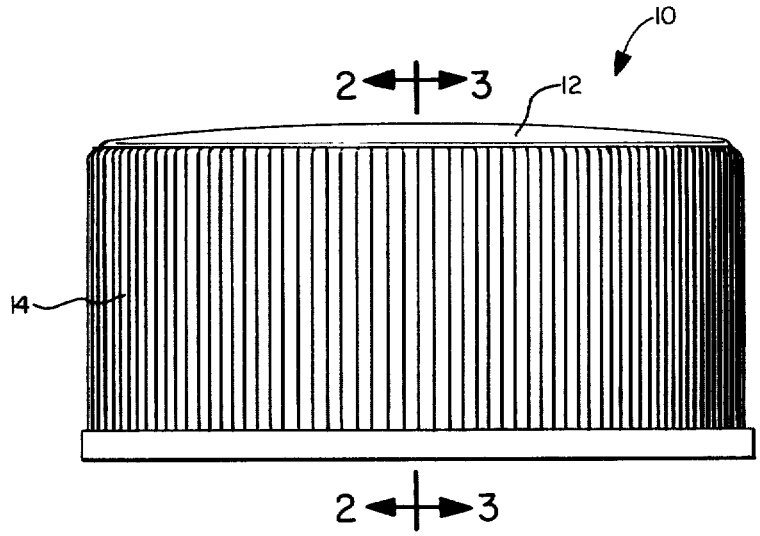
FIG. 1 is a front elevational view of a thermoplastic closure of this invention.
Figure 2:
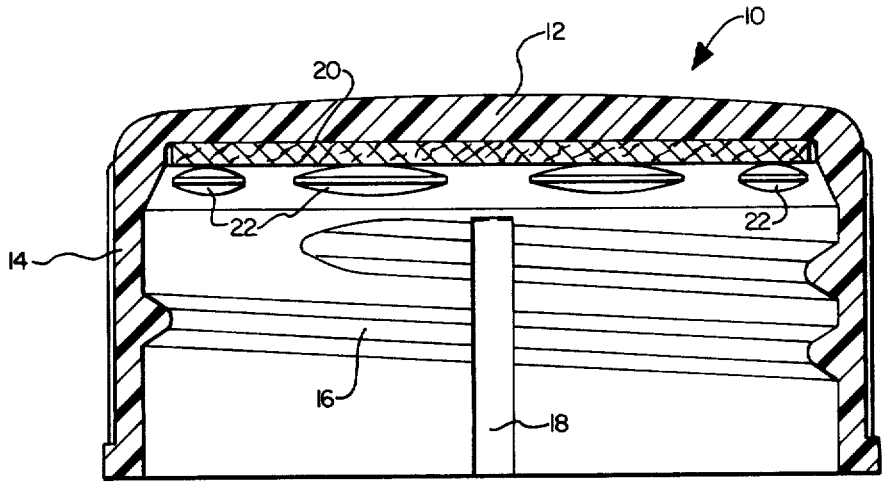
FIG. 2 is a sectional view taken through section line 2—2 in FIG. 1.
Figure 3:
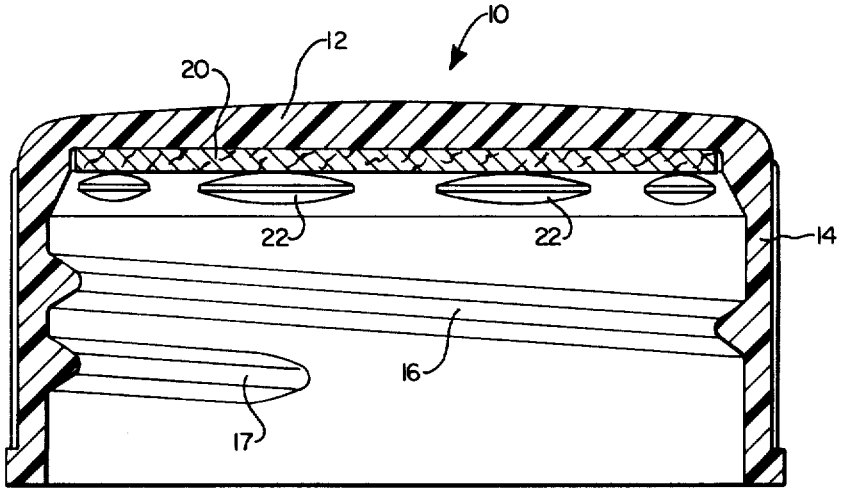
FIG. 3 is a sectional view taken through section line 3—3 in FIG. 1.

As can be seen from FIGS. 1–3, the closure of this invention, generally designated by the numeral 10, has a top wall 12 and a downwardly, depending annular sidewall 14. About the inside surface of annular sidewall 14 is a helical closure thread 16. In FIG. 3, the extended portion of thread 16 is shown and labeled with the number 17. As stated previously, closure thread 16 traverses from about 400 to about 500 degrees. It has been found that by having such an extended closure thread, the user of the closure of this invention will be required to make two turning motions to remove the closure from the container. If closure thread 16 was not extended, i.e., it only traversed about 360 degrees, the user could remove closure 10 from the container with a single turning motion. The two turning motions are beneficial as they allow for enough time to elapse so that the pressurized gas in the container will have sufficient time to vent.

One system useful in venting the pressurized gas in the container is the one shown in FIGS. 2 and 3. Note that vent groove 18 extends from a point above closure thread 16 to a point near the bottom portion of sidewall 14. Venting groove 18 is cut into the inside surface of sidewall 14 and has a width which provides the necessary cross-sectional escapement area needed for venting of pressurized gas in the container within the time necessary for removal of closure 10 from the container.

To form a seal between closure 10 and the container lip, there is provided liner 20. Retaining beads 22 are utilized to keep liner 20 in proper position adjacent the inside surface of top wall 12. It is to be understood that while the closure shown in FIGS. 1-3 utilizes a liner that it is fully within the scope of this invention for the closure to use a linerless sealing system. Such linerless sealing systems are well known to those skilled in the art.

What is claimed:

1. A thermoplastic closure suitable for fitment to a threaded container neck, which closure comprises:

(a) a top wall;

(b) an annular sidewall downwardly depending from said top wall;

(c) a sealing liner positioned adjacent said top wall, said sealing liner cooperating with the upper portion of said container neck to effect a fluid tight seal when said closure is fitted to said container;

(d) a plurality of spaced apart retaining beads on the upper inside portion of said annular sidewall below said sealing liner, said retaining beads maintaining said sealing liner in its said position adjacent said top wall;

(e) a closure thread carried on the inside surface of said annular sidewall for cooperation with said container neck thread; and (f) a vertical venting groove inside said surface of said sidewall, said venting groove, (i) extending from a point above said closure thread to a point adjacent to the lowermost portion of said annular sidewall, (ii) interrupting said closure thread at each intersection of said venting groove with said closure thread, and (iii) being positioned at its uppermost extent at a point adjacent the space between two of said retaining beads.

2. The closure of claim 1 wherein said closure thread traverses from about 400 to about 500 degrees.

3. The closure of claim 2 wherein said closure is made of polypropylene.

4. The closure of claim 1 wherein said closure is made of polypropylene.

* * * * *